US007300139B2

(12) United States Patent
Nakazawa

(10) Patent No.: US 7,300,139 B2
(45) Date of Patent: Nov. 27, 2007

(54) INK JET RECORDING APPARATUS USING CHARGED FINE PARTICLE-CONTAINING INK

(75) Inventor: Yusuke Nakazawa, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 239 days.

(21) Appl. No.: 10/945,900

(22) Filed: Sep. 22, 2004

(65) Prior Publication Data

US 2005/0062808 A1 Mar. 24, 2005

(30) Foreign Application Priority Data

Sep. 24, 2003 (JP) ..... 2003-331986
Dec. 26, 2003 (JP) ..... 2003-432165

(51) Int. Cl.
*B41J 2/17* (2006.01)

(52) U.S. Cl. ..... 347/84

(58) Field of Classification Search ..... 347/84, 347/54, 55, 101; 399/237, 225; 209/12.2
See application file for complete search history.

(56) References Cited

U.S. PATENT DOCUMENTS 3,441,437 A * 4/1969 Benn et al. ..... 430/108.6
4,737,268 A * 4/1988 Giddings ..... 209/12.2
4,799,452 A * 1/1989 Day ..... 399/225
5,036,365 A * 7/1991 Landa ..... 399/237
6,158,844 A * 12/2000 Murakami et al. ..... 347/55
6,604,816 B1 * 8/2003 Yonekura et al. ..... 347/54
2002/0012035 A1 * 1/2002 Mouri et al. ..... 347/100
2002/0041311 A1 * 4/2002 Oishi ..... 347/68
2003/0000869 A1 * 1/2003 Morales Tirado et al. .. 209/142
2004/0001134 A1 * 1/2004 Nakazawa et al. ..... 347/101

FOREIGN PATENT DOCUMENTS

EP 0 774 354 A2 5/1997
EP 0 778 135 A2 6/1997
EP 0 844 087 A2 5/1998
EP 1 442 886 A1 8/2004
JP 3288279 B2 3/2002

* cited by examiner

*Primary Examiner*—Hai Pham
*Assistant Examiner*—Carlos A. Martinez, Jr.
(74) *Attorney, Agent, or Firm*—Sughrue Mion, PLLC

(57) ABSTRACT

The ink jet recording apparatus includes an ink jet head that causes an electrostatic force to act on ink containing charged colored particles based on an image signal to eject an ink droplet on a recording medium, an ink supply unit that supplies the ink to the ink jet head, an ink collection unit that collects the ink not ejected from the ink jet head and a particle diameter distribution narrowing unit that narrows a particle diameter distribution of the charged colored particles contained in the ink. The narrowing unit includes an electrode cleaning unit that cleans an electrode for generating electrophoresis in the ink.

19 Claims, 7 Drawing Sheets

INK JET RECORDING APPARATUS USING CHARGED FINE PARTICLE-CONTAINING INK

BACKGROUND OF THE INVENTION

The present invention relates in general to an ink jet recording apparatus for ejecting charged fine particle-containing ink to record an image using electrostatic field, and more particularly to an ink jet recording apparatus configured to narrow a particle diameter distribution of the fine particles to prevent degradation of image quality of a recorded image.

An electrostatic ink jet recording system uses charged fine particle-containing ink, and a predetermined drive voltage is applied to control electrodes provided in the vicinities of ink nozzles (through holes) of an ink jet head based on image data to control ejection of ink droplets by utilizing electrostatic forces. As a result, an image corresponding to the image data is recorded on a recording medium.

In JP 3,288,279 B for example, there is disclosed an ink jet recording apparatus including: a control substrate disposed so as to face a recording medium, the control substrate including an insulating support substrate, and first and second control electrodes disposed on both sides of the insulating support substrate, respectively, the control substrate having at least one through hole formed so as to extend completely through the first and second control electrodes and the insulating support substrate; ink supply means for supplying ink to the through hole of the control substrate, the ink supply means having a porous member disposed so as to contact the second control electrode; and signal voltage application means for applying a signal voltage corresponding to an image signal across the first and second control electrodes.

In this ink jet recording apparatus, a bias voltage is applied across the first and second control electrodes, and the signal voltage superposed on the bias voltage is applied across the first and second control electrodes. As a result, positively charged colored particles move to an ink surface within the through hole. When an amount of colored particles becomes equal to or more than a given amount, an electrostatic force acting on the ink surface increases beyond an ink surface tension, with the result that the electrostatic force breaks the ink surface to eject the charged colored particles with a high concentration.

Then, in the above-mentioned ink jet recording apparatus, the charged colored particles with a high concentration are ejected in such a manner, whereby an image having less bleeding can be formed, fine recording picture dots can be formed on a recording medium, an image having high resolution can be readily recorded, and moreover an image having high resolution can be formed irrespective of recording media.

However, in the ink jet recording apparatus disclosed in JP 3,288,279 B, as will be described later, the concentration of the charged colored particles may become unstable, or an ejection state of the charged colored particles may become unstable. In particular, when the continuous recording is carried out, this tendency becomes remarkable.

SUMMARY OF THE INVENTION

The present invention has been made in light of the above-mentioned circumstances, and it is, therefore, an object of the present invention to provide an ink jet recording apparatus which is capable of, even when continuous recording is carried out, stabilizing a concentration and ejection state of charged fine particles such as charged colored particles to stably form an image with high quality by solving the above-mentioned problems associated with the prior art.

In order to attain the object described above, the present invention provides an ink jet recording apparatus, comprising an ink jet head for causing an electrostatic force to act on ink containing charged colored particles based on an image signal to eject an ink droplet on a recording medium, ink supply means for supplying the ink to the ink jet head, ink collection means for collecting the ink not ejected from the ink jet head, and particle diameter distribution narrowing means for narrowing a particle diameter distribution of the charged colored particles contained in the ink.

Preferably, the ink collection means is ink recovery means for recovering the ink not ejected from the ink jet head to the ink supply means, and the ink supply means and the ink recovery means constitute ink circulation means in which the ink is circulated between the ink supply means and the ink recovery means by flowing the not-ejected ink from the ink jet head to the ink supply means by the ink recovery means.

And, it is preferable that the ink jet recording apparatus further comprises concentration detecting means for detecting a concentration of the charged colored particles in the ink circulating in the ink circulation means, and ink replenishment means for replenishing the ink with the colored particles in accordance with detection results obtained by the concentration detecting means.

Preferably, the ink replenishment means replenishes the ink circulating in the ink circulation means with concentrated ink containing the colored particles at a high concentration.

Preferably, the particle diameter distribution narrowing means is disposed in a supply path for the ink supplied by the ink supply means or a collection path for the ink collected by the ink collection means.

Preferably, the particle diameter distribution narrowing means utilizes electrophoresis.

Preferably, the particle diameter distribution narrowing means is provided with an electrode for causing electrophoresis of the colored particles in the ink.

Preferably, the particle diameter distribution narrowing means includes a main tube forming an ink inflow passage into which the ink flows from the ink supply means or the ink collection means, two branch tubes diverging from the main tube, each of which forms an ink outflow passage and out of which at least one is connected back to the ink supply means or the ink collection means, and flat plate type electrodes disposed so as to sandwich the main tube.

Preferably, the particle diameter distribution narrowing means includes electrode cleaning means for cleaning the electrode.

Preferably, the electrode of the particle diameter distribution narrowing means is a movable electrode, and the electrode cleaning means is a scraping blade which is slidably in contact with the movable electrode.

Preferably, the movable electrode of the particle diameter distribution narrowing means is moved in a same direction as a flow direction of the ink flowing through the particle diameter distribution narrowing means and at a velocity nearly equal to a flow velocity of the ink.

Preferably, the movable electrode of the particle diameter distribution narrowing means has a surface which comes into contact with the ink, and the surface is coated with a fluoroplastic.

Moreover, in order to attain the object described above, the present invention provides an electrostatic type color ink jet recording apparatus, comprising an ink jet head for causing an electrostatic force to act on ink containing charged colored particles based on an image signal to eject an ink droplet on a recording medium, and particle diameter distribution narrowing means for narrowing a particle diameter distribution of the colored particles in the ink by utilizing electrophoresis of the colored particles in the ink, wherein the particle diameter distribution narrowing means includes an electrode for causing the electrophoresis and electrode cleaning means for cleaning the electrode.

Preferably, the electrode of the particle diameter distribution narrowing means is a movable electrode, and the electrode cleaning means is a scraping blade which is slidably in contact with the movable electrode.

Preferably, the movable electrode of the particle diameter distribution narrowing means is moved in a same direction as a flow direction of the ink flowing through the particle diameter distribution narrowing means and at a velocity nearly equal to a flow velocity of the ink.

Preferably, the movable electrode of the particle diameter distribution narrowing means has a surface which comes into contact with the ink, and the surface is coated with a fluoroplastic.

According to results of studies made by the inventor of the present invention, concentration and ejection state of charged colored particles may often become unstable in conventional ink jet recording apparatuses, and in particular, this tendency becomes remarkable when the continuous recording is carried out, and this is because the colored particles having various particle diameters are contained in the ink. That is to say, the particles having large diameters are excellent in ejection property and concentration property, while the particles having small particle diameters are poor in the ejection property and the concentration property. Thus, if the recording is carried out using the ink including both types of particles, there is shown such a tendency that the particles having large particle diameters are ejected first, and many particles having small particle diameters are left in the ink flowing through an ink circulation system.

That is, as the ink is ejected, the particle diameter distribution of the colored particles in the ink is shifted to a side where many particles have small particle diameters. However, those particles having small particle diameters are hardly ejected, and even if those particles having small particle diameters could be ejected, those particles having small particle diameters are hardly concentrated. As a result, only an image having much bleeding can be formed, and hence an image cannot be satisfactorily recorded. The inventor of the present invention has found out that degradation of the image quality is caused because of not only the unstable concentration of the colored particles in the ink but also the unstable ejection state of the ink droplet due to the change in particle diameter distribution of the colored particles in the ink.

While such a problem can be solved by using ink containing colored particles whose particle diameters are uniform, such ink is very expensive. This is another problem. Moreover, there is also encountered a problem in that even if the particles having uniform particle diameters are used as the colored particles to be contained in the ink, the colored particles contained in the ink are broken or split due to contact with a passage or the like during circulation through the ink passage, becoming particles having smaller particle diameters, and hence the same problem as that of the foregoing arises.

Then, the inventor of the present invention has found out that in order to obtain a more uniform particle diameter distribution of the colored particles contained in the ink supplied from an ink jet head during recording, it is effective to successively remove the particles having small particle diameters from the circulating ink. Thus, the inventor of the present invention has filed the present application related to the ink jet recording apparatus including particle diameter distribution narrowing means for successively removing particles having small particle diameters from the circulating ink.

The above description is an outline of the progress leading to the present invention.

According to the present invention, even when the continuous recording is carried out, the concentration and the ejection state of charged fine particles can be stabilized without frequently exchanging ink for another, and hence an image with high image quality can be drawn irrespective of a recording medium.

In addition, according to the present invention, it becomes possible to stably record an image, and hence it is possible to realize the ink jet recording apparatus which is excellent in a running cost and influence exerted on an environment.

This application claims priority on Japanese patent applications No. 2003-331986 and No. 2003-432165, the entire contents of which are hereby incorporated by reference.

DETAILED DESCRIPTION OF THE INVENTION

An electrostatic type ink jet recording apparatus of the present invention will hereinafter be described in detail based on preferred embodiments shown in the accompanying drawings.

Figure 1:
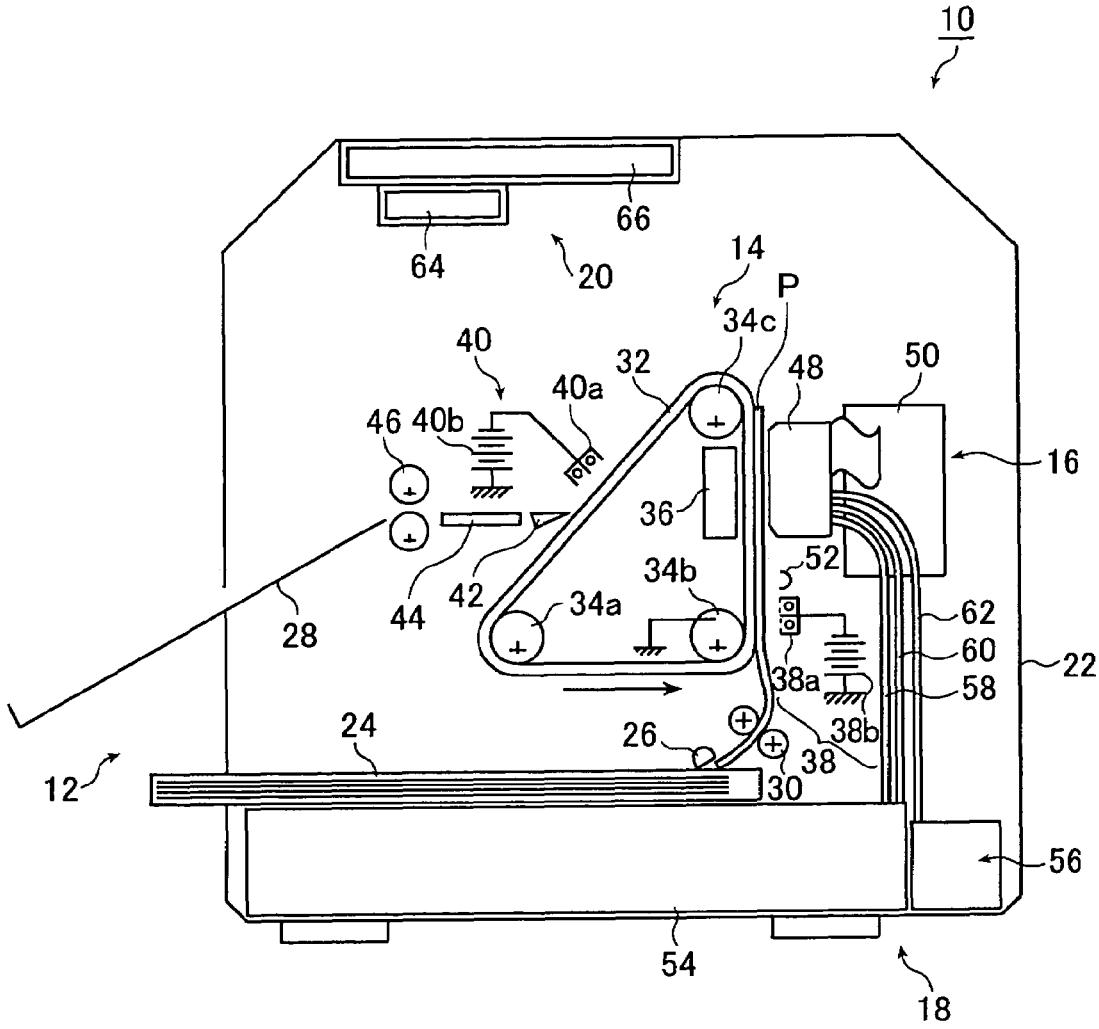
FIG. 1 is a schematic view showing an overall construction of an electrostatic type ink jet recording apparatus according to an embodiment of the present invention.

FIG. 1 is a schematic view showing an overall construction of the electrostatic type ink jet recording apparatus according to an embodiment of the present invention. An electrostatic type ink jet recording apparatus 10 shown in the figure serves to control ejection of charged fine particle-containing ink to record a monochrome image on a recording medium (recording sheet) P through a monochrome printing process by utilizing an electrostatic force. The electrostatic type ink jet recording apparatus 10 includes means 12 for holding the recording medium P, conveyance means 14, recording means 16, ink circulation means 18, solvent collection means 20, and a casing 22.

The means 12 for holding the recording medium P includes a sheet feeding tray 24 for holding the recording medium P before the recording, a feed roller 26, and a sheet discharging tray 28 for holding the recording media P after completion of the recording.

A front end portion of the sheet feeding tray 24 is inserted into the inside of an installation portion for the sheet feeding tray 24 (provided on a lower portion on the left-hand side of the casing 22 in the figure). In this connection, the sheet feeding tray 24 is detachably inserted into a predetermined position of the installation portion. In a state in which the sheet feeding tray 24 is perfectly installed in the installation portion, the front end portion of the sheet feeding tray 24 in an insertion direction contacts an inner end portion of the installation portion, and a rear end portion of the sheet feeding tray 24 projects to the outside of the casing 22. In addition, the feed roller 26 is disposed in the vicinity of an inner portion of the installation portion for the sheet feeding tray 24.

A plurality of sheets of recording media P before the recording are stocked on top of one another within the sheet feeding tray 24. In recording an image, the recording media P are taken out one by one from the sheet feeding tray 24 by the feed roller 26 to be supplied to the conveyance means 14 for the recording medium P.

The discharge tray 28 is disposed in the vicinity of a discharge portion for the recording medium P (corresponding to a central portion on the left-hand side of the casing 22 in the figure) so that a front end portion side (toward which the recording medium P is conveyed) is located outside the casing 22, and a rear end portion thereof is located inside the casing 22. In addition, the discharge tray 28 is disposed at a predetermined inclination angle with a horizontal line so that the front end portion thereof is lower in position than the rear end portion thereof.

The recording media P after completion of the recording are conveyed by the conveyance means 14 to be discharged through the discharge portion, and are then successively stocked on top of one another within the discharge tray 28.

The conveyance means 14 is means for electrostatically attracting the recording medium P to convey the recording medium P along a predetermined path from the sheet feeding tray 24 to the discharge tray 28. The conveyance means 14 includes a conveyance roller pair 30, a conveyance belt 32, belt rollers 34*a*, 34*b*, and 34*c*, an electrically conductive platen 36, a charger 38 and a discharger 40 for the recording medium P, a separation claw 42, a guide 44, and a fixing roller pair 46.

The conveyance roller pair 30 is provided in a position between the feed roller 26 and the conveyance belt 32 on the conveyance path for the recording medium P.

The recording medium P taken out from the sheet feeding tray 24 by the feed roller 26 is held and conveyed by the conveyance roller pair 30 to be supplied to a predetermined position on the conveyance belt 32.

The charger 38 for the recording medium P includes a scorotron charger 38*a* and a negative high voltage power source 38*b*. The scorotron charger 38*a* is disposed in a position between the conveyance roller pair 30 and the recording means 16 along the conveyance path for the recording medium P, i.e., in a position facing the surface of the conveyance belt 32 in a position to which the recording medium P is supplied by the conveyance roller pair 30. In addition, a negative side terminal of the negative high voltage power source 38*b* is connected to the scorotron charger 38*a*, and a positive side terminal of the negative high voltage power source 38*b* is grounded.

The surface of the recording medium P is uniformly charged at a predetermined negative high voltage by the scorotron charger 38*a* connected to the negative high voltage power source 38*b*, and thus is in a state of being always biased at a given D.C. bias voltage (e.g., about −1.5 kV). As a result, the recording medium P is electrostatically attracted to the surface of the conveyance belt 32 having an insulation property.

The conveyance belt 32 is an endless belt, and is suspended in a triangular shape by the three belt rollers 34*a*, 34*b*, and 34*c*. In addition, the flat plate-like conductive platen 36 is disposed in an inner portion of the conveyance belt 32 corresponding to a position facing the recording means 16.

A face of the conveyance belt 32 on which the recording medium P is to be electrostatically attracted (front side) has the insulation property, and a face of the conveyance belt 32 adapted to contact the belt rollers 34*a*, 34*b*, and 34*c* (rear side) has the conduction property. The belt roller 34*b* is grounded, and hence the belt rollers 34*a* and 34*c*, and the conductive platen 36 are also grounded through the rear surface of the conveyance belt 32. As a result, a portion of the conveyance belt 32 located in a position facing the recording means 16 functions as a counter electrode of the ink jet head.

At least one of the belt rollers 34*a*, 34*b*, and 34*c* is connected to a drive source (not shown), and is driven and rotated at a predetermined speed during the recording. As a result, during the recording, the conveyance belt 32 is moved in a direction indicated by an arrow in the figure. Consequently, as the conveyance belt 32 moves, the recording medium P is moved to be conveyed while the recording medium P faces the recording means 16.

The discharger 40 for the recording medium P includes a corotron discharger 40*a* and a high voltage power source 40*b*. The corotron discharger 40*a* is disposed in a position between the recording means 16 and the separation claw 42 along the conveyance path for the recording medium P, i.e., in a position facing the surface of the conveyance belt 32 corresponding to a position to which the recording medium P after completion of the recording is conveyed. In addition, one terminal of the high voltage power source 40*b* is connected to the corotron discharger 40*a*, and the other terminal of the high voltage power source 40*b* is grounded.

The electric charges on the recording medium P after completion of the recording are discharged by the corotron discharger 40*a* connected to the high voltage power source 40*b*. As a result, the recording medium P becomes easy to be separated from the conveyance belt 32.

In addition, the separation claw 42, the guide 44, and the fixing roller pair 46 are disposed in this order on a downstream side of the discharger 40 along the conveyance path for the recording medium P.

The recording medium P the electric charges on which have been discharged by the discharger 40 is separated from the conveyance belt 32 by the separation claw 42 to be supplied to the fixing roller pair 46 along the guide 44. The fixing roller pair 46 is a pair of rollers including a heat roller. An image recorded on the recording medium P is fixed through the contact and the heating while the recording medium P is held and conveyed by the fixing roller pair 46. The recording media P after completion of the fixation are discharged through the discharge portion to be successively stocked on top of one another within the discharge tray 28.

Subsequently, the recording means 16 for the recording medium P will be described.

The recording means 16 serves to record a monochrome image on the recording medium P with the electrostatic force through the monochrome printing. The recording means 16 includes a head unit 48, a head driver 50, and a position detector 52 for detecting a position of the recording medium P on the conveyance path.

Figure 2:
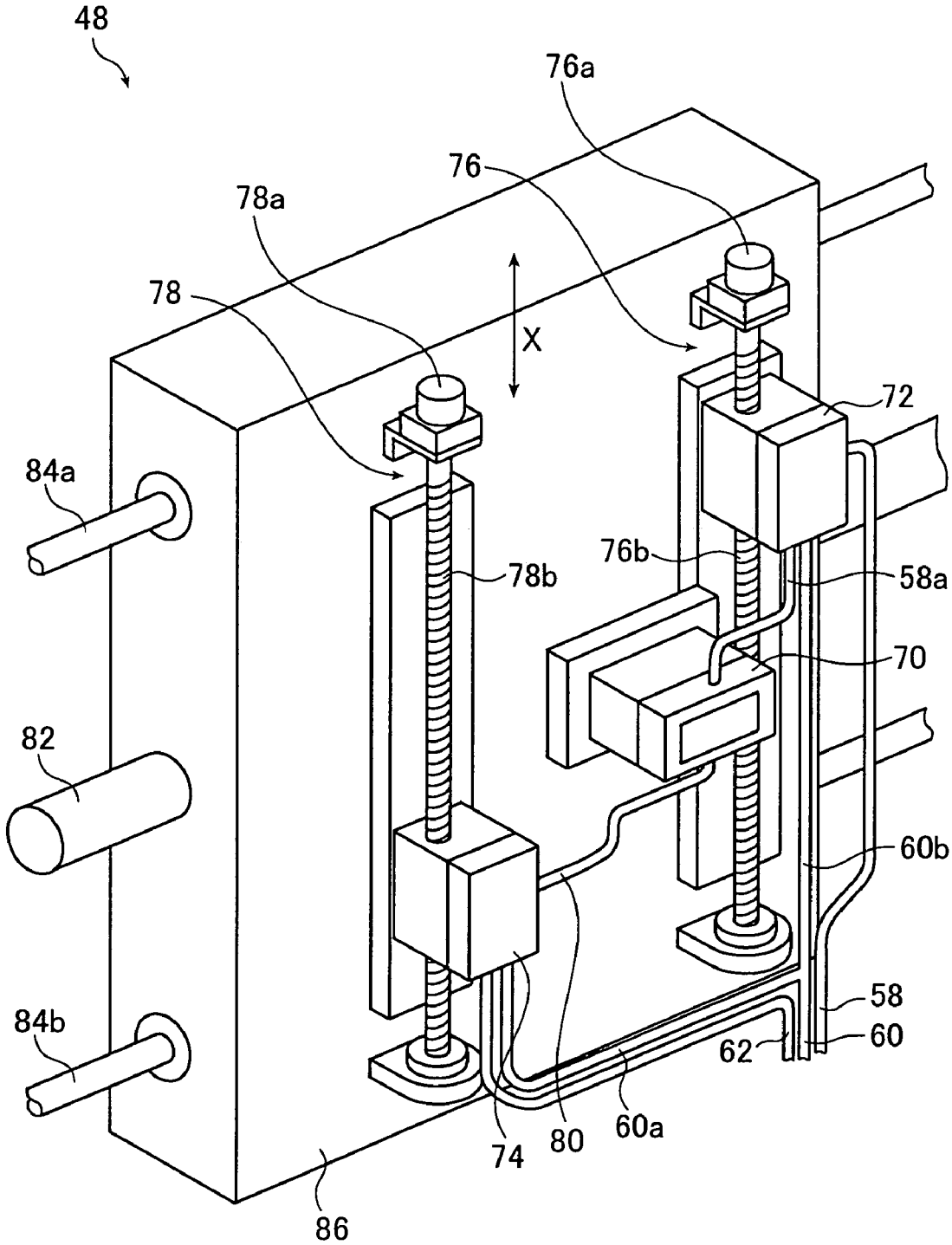
FIG. 2 is an enlarged perspective view of a head unit according to the embodiment of the present invention.

FIG. 2 is an enlarged perspective view showing a construction of the head unit 48. In the figure, the conveyance direction of the conveyance belt 32 is indicated by an arrow X.

The head unit 48 includes a recording head 70, an ink supply sub-tank 72, an ink recovery/disposal sub-tank 74, sub-tank position adjustment mechanisms 76 and 78 (on a side of the ink supply sub-tank 72 and on a side of the ink recovery/disposal sub-tank 74, respectively), drive means 82, guide rails 84*a* and 84*b*, and a support member 86.

The guide rails 84*a* and 84*b* are disposed in parallel at a predetermined distance from each other in a direction intersecting perpendicularly the conveyance direction (indicated by the arrow X) of the conveyance belt 32.

The drive means 82 includes a ball screw and the like adapted to be driven by a motor (not shown). The drive means 82 is disposed between the guide rails 84*a* and 84*b*.

The support member 86 is supported by the guide rails 84*a* and 84*b*, and the drive means 82 and thus is adapted to be moved in a direction intersecting perpendicularly the conveyance direction (indicated by the arrow X) of the conveyance belt 32 along the guide rails 84*a* and 84*b* by the drive means 82. In addition, the support member 86 has a plate-like shape. The recording head 70, the ink supply sub-tank 72, the ink recovery/disposal sub-tank 74, the sub-tank position adjustment mechanisms 76 and 78 (on the side of the ink supply sub-tank 72 and on the side of the ink recovery/disposal sub-tank 74, respectively) are disposed on the support member 86.

The sub-tank position adjustment mechanisms 76 and 78 (on the side of the ink supply sub-tank 72 and on the side of the ink recovery/disposal sub-tank 74, respectively) disposed on the support member 86 support the ink supply sub-tank 72, and the ink recovery/disposal sub-tank 74, respectively. In addition, the sub-tank position adjustment mechanisms 76 and 78 include motors 76*a* and 78*a*, respectively, and thus serve to drive the respective motors 76*a* ad 78*a* to move the ink supply sub-tank 72, and the ink recovery/disposal sub-tank 74 in a vertical direction (in a direction indicated by the arrow X).

Here, while as for the sub-tank position adjustment mechanisms 76 and 78, there may be used ones of a system adapted to drive ball screws 76*b* and 78*b* by the motors 76*a* and 78*a*, the present invention is not intended to be limited thereto, and hence various position adjustment mechanisms of other systems can be utilized as the sub-tank position adjustment mechanisms 76 and 78. Note that since the position of the sub-tank is not frequently changed basically, there may also be adopted such a construction that the position of the sub-tank is manually adjusted.

In addition, the ink supply sub-tank 72, the ink recovery/disposal sub-tank 74, and an ink supply tube 58, an ink recovery tube 60, and an ink disposal tube 62 will be described in detail in a paragraph of the ink circulation means 20.

The recording head 70 is fixed on the support member 86, and includes a monochrome ink jet head for recording a monochrome image using black (B) ink for example.

Here, a concrete head construction of the electrostatic type ink jet head is shown in FIGS. 3, 4A and 4B, and 5A to 5C. As well known, the electrostatic type ink jet system is a system for controlling ejection of charged colored particle-containing ink used in the recording head 70 by utilizing an electrostatic force.

Figure 3:
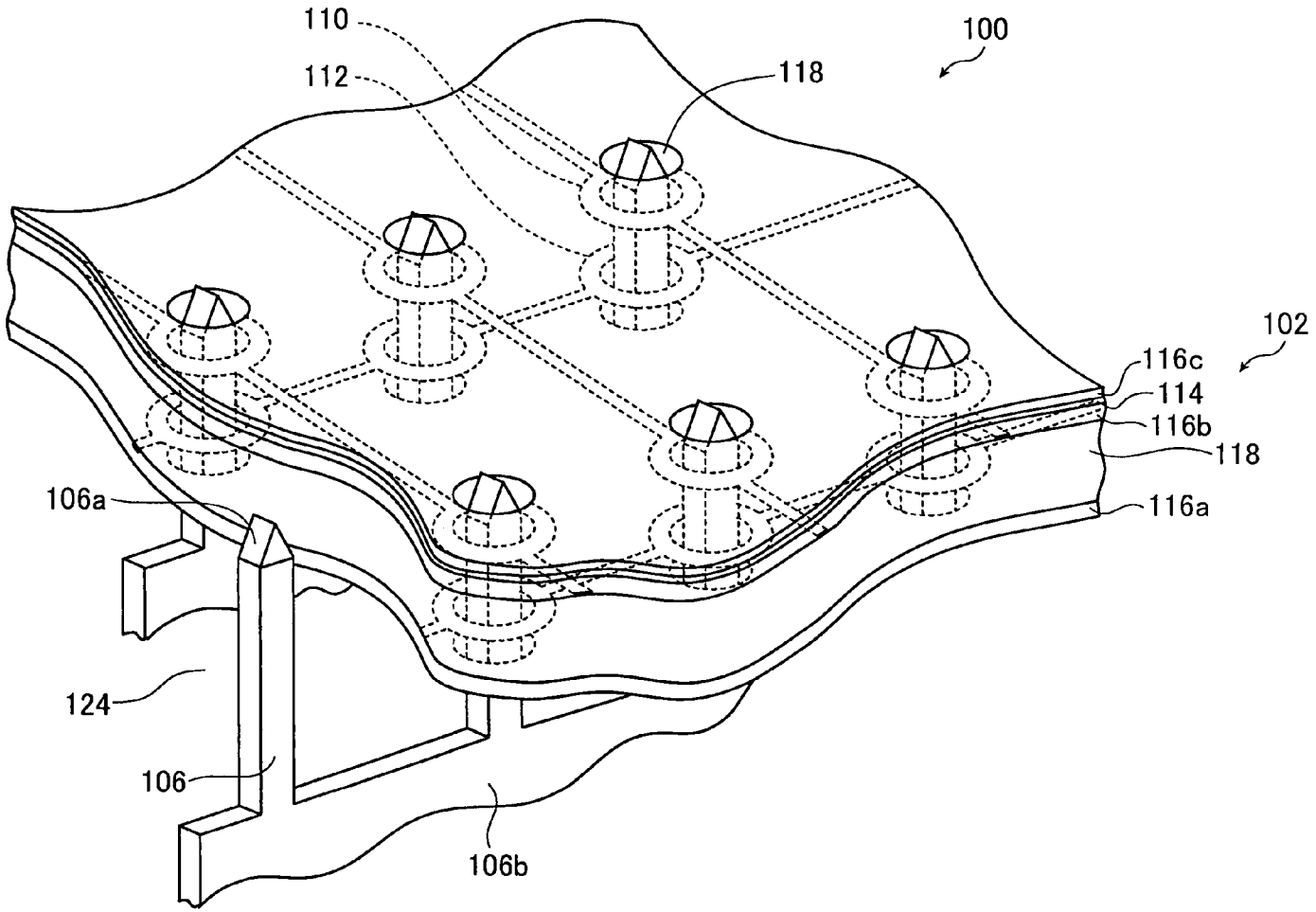
FIG. 3 is a schematic perspective view showing a construction of the electrostatic type ink jet head according to the embodiment of the present invention.
Figure 4A:
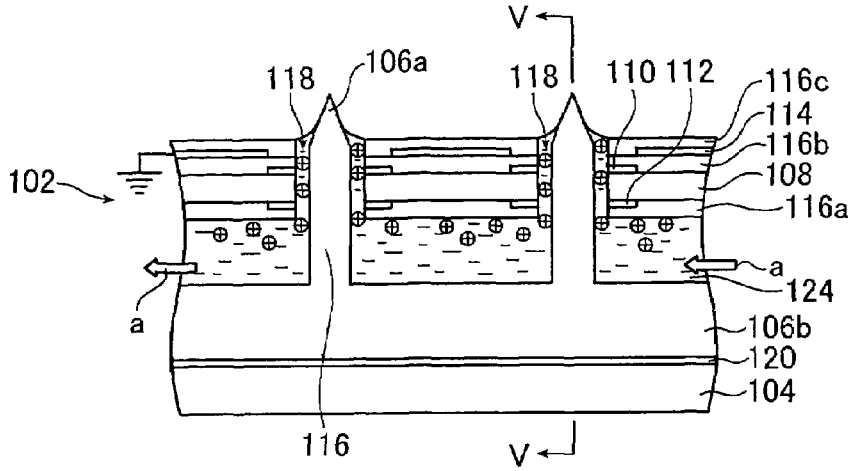
FIGS. 4A and 4B are a schematic cross sectional view of the electrostatic type ink jet head shown in FIG. 3, and a cross sectional view taken along line V-V of FIG. 4A.
Figure 4B:
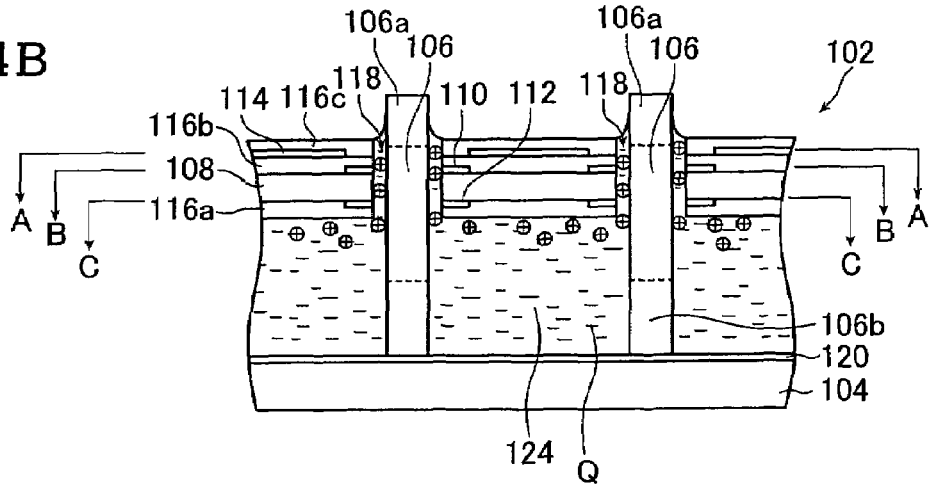
Figure 5A:
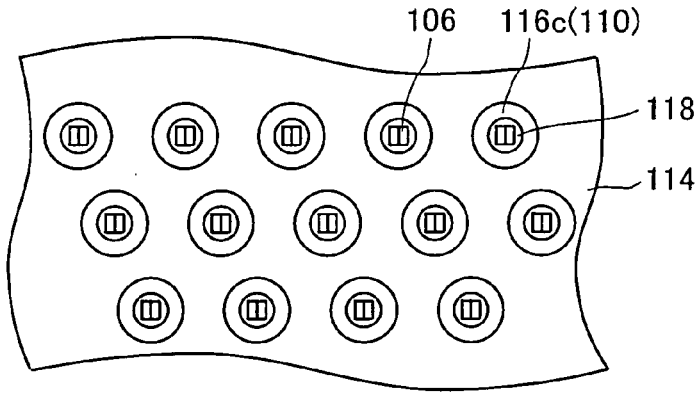
FIGS. 5A, 5B, and 5C are respectively cross sectional views taken along line A-A, line B-B, and line C-C of FIG. 4B.
Figure 5B:
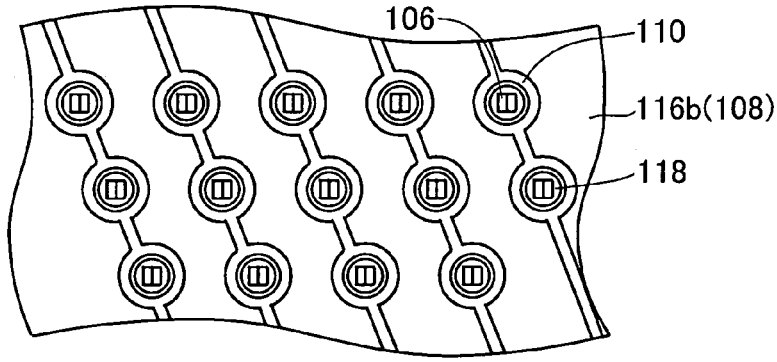
Figure 5C:
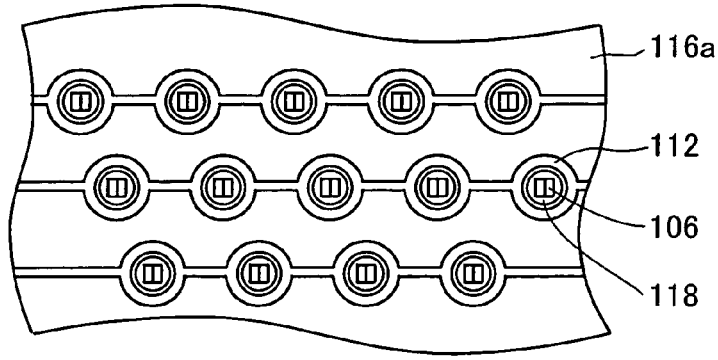

FIG. 3 is a schematic partial perspective view showing a schematic construction of an embodiment of an electrostatic type ink jet head 100 used in the recording head 70 shown in FIG. 2. In addition, FIG. 4A is a schematic cross sectional view of the electrostatic type ink jet head 100 shown in FIG. 3 and FIG. 4B is a cross sectional view taken along line V-V of FIG. 4A. Also, FIGS. 5A, 5B, and 5C are respectively cross sectional views taken along line A-A, line B-B, and line C-C of FIG. 4B.

Here, ink Q (ink composition) used in the present invention is obtained by dispersing colored particles (charged fine particles which contain colorants) in a carrier liquid.

In addition, dispersion resin particles for enhancement of the fixing property of an image after completion of the printing may be contained together with the colored particles in the ink Q.

The carrier liquid is preferably a dielectric liquid (non-aqueous solvent) having a high electrical resistivity (equal to or larger than $10^9$ Ω·cm, and is more preferably equal to or larger than $10^{10}$ Ω·cm). If the electrical resistance of the carrier liquid having a low electrical resistivity is low, the concentration of the colored particles does not occur since the carrier liquid itself receives the injection of the electric charges to be charged due to a voltage applied from ejection electrodes as will be described later. In addition, since there is also anxiety that the carrier liquid having a low electrical resistivity causes the electrical conduction between the adjacent ejection portions, the carrier liquid having a low electrical resistivity is unsuitable for the present invention.

A relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colored particles contained in the carrier liquid to facilitate the electrophoresis of the colored particles.

Note that an upper limit of the specific electrical resistance of such a dielectric liquid is desirably about $10^{16}$ Ω·cm, and a lower limit of the relative permittivity is desirably about 1.9. The reason why the electrical resistance of the dielectric liquid preferably falls within the above-mentioned range is that if the electrical resistance becomes low, then the ejection of the ink under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as a carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colored particles dispersed in the carrier liquid, colorants themselves may be dispersed as the colored particles into the carrier liquid. Alternatively, the colored particles may also be contained in dispersion resin particles for enhancement of fixing property. In the case where the colorants are contained in the dispersion resin particles, in general, there is adopted a method in which the pigments or the like are covered with the resin material of the dispersion resin particles to obtain the particles covered with the resin, and the dispersion resin particles are colored with the dyes or the like to obtain the colored particles.

As the colorants, all the ink composition for ink jet recording, the (oily) ink composition for printing, or the pigments and dyes used in the liquid developer for electrostatic photography may be used as in the past.

In the ink Q, a content of colored particles (a total content of colored particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of colored particles decreases, the following problems become easy to arise. The density of the printed image is insufficient, the affinity between the ink Q and the surface of the recording medium P becomes difficult to be obtained to disable the image firmly stuck to the surface of the recording sheet from being obtained, and so forth. On the other hand, if the content of colored particles increases, problems occur in that the uniform dispersion liquid becomes difficult to obtain, the clogging of the ink Q is easy to occur in the ink jet head 100 or the like to make it difficult to obtain the stable ink ejection, and so forth. The reason why the above-mentioned range is selected for the content of colored particles is to prevent those problems from arising.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

In addition, an average particle diameter of the colored particles dispersed in the carrier liquid preferably falls with in a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA LTD.).

After the colored particles are dispersed in the carrier liquid, a charging control agent is added to the resultant carrier liquid to charge the colored particles, and the charged colored particles are dispersed in the resultant liquid to thereby produce the ink Q. Note that in dispersing the colored particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colored particles may be positively or negatively charged as long as the charged colored particles are identical in polarity to the drive voltages applied to ejection electrodes which will be described later.

In addition, a charging amount of colored particles is preferably in a range of 5 to 200 μC/g, more preferably in a range of 10 to 150 μC/g, and much more preferably in a range of 15 to 100 μC/g.

In addition, the electrical resistance of the dielectric liquid may be changed by adding the charging control agent in some cases. Thus, a distribution factor P defined below is preferably equal to or larger than 50%, more preferably equal to or larger than 60%, and much more preferably equal to or larger than 70%.

$$P=100\times(\sigma1-\sigma2)/\sigma1$$

where σ1 is an electric conductivity of the ink Q, and σ2 is an electric conductivity of a supernatant liquid which is obtained by inspecting the ink Q with a centrifugal separator. Those electric conductivities were obtained by measuring the electric conductivities of the ink Q and the supernatant liquid under a condition of an applied voltage of 5 V and a frequency of 1 kHz using an LCR meter of an AG-4311 type (manufactured by ANDO ELECTRIC CO., LTD.) and electrode for liquids of an LP-05 type (manufactured by KAWAGUCHI ELECTRIC WORKS, CO., LTD.). In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink Q as described above is used, which results in that the colored particles are likely to migrate and hence the colored particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent recording electrodes.

In addition, a surface tension of the ink Q is preferably in a range of 15 to 50 mN/m, more preferably in a range of 15.5 to 45.0 mN/m, and much more preferably in a range of 16 to 40 mN/m. The surface tension is set to this range, resulting in that the applied voltages to the ejection electrodes are not excessively high, and also the ink does not leak and spread to the periphery of the head to contaminate the head.

Moreover, a viscosity of the ink Q is preferably in a range of 0.5 to 5.0 mPa·sec, more preferably in a range of 0.6 to 3.0 mPa·sec, and much more preferably in a range of 0.7 to 2.0 mPa·sec.

The ink used in the present invention is basically as described above.

The electrostatic type ink jet head 100 shown in FIGS. 3, 4A and 4B, and 5A to 5C serves to eject the ink Q containing the colored particle components (e.g., toners or the like) such as the charged pigments as described above by utilizing the electrostatic force to record an image on the image recording medium P (hereinafter referred to as "the recording medium P" for short) based on image data.

As shown in FIG. 3, and FIGS. 4A and 4B, an electrostatic type ink jet head (hereinafter referred to as "an ink jet head" for short) 100 includes an ejection opening substrate 102, a head substrate 104, and an ink guide 106. The ejection opening substrate 102 includes an insulating substrate 108, a second ejection electrode 112 provided on a lower surface of the insulating substrate 108 in the figure, an insulating layer 116*a* provided below the second ejection electrode 112, a first ejection electrode 110 provided on an upper surface of the insulating substrate 108 in the figure, an insulating layer 116*b* provided above the first ejection electrode 110, a guard electrode 114, and an insulating layer 116*c*. The first and second ejection electrodes 110 and 112 are connected to control means (not shown) for outputting signal voltages corresponding to an image signal to the first and second ejection electrodes 110 and 112, respectively. In addition, a floating conductive plate 120 is disposed inside the head substrate 104. Also, the ink jet head 100 is disposed so as to face the conveyance belt 32 (refer to FIG. 1) for supporting the recording medium P acting as a counter electrode.

In the ink jet head 100 of the illustrated example, the ink guide 106 is a flat plate which is made of ceramics having a predetermined thickness and which has a convex tip portion 106*a*. The convex tip portion 106*a* is formed so as to project upwardly from a base portion 106*b*, and the base portion 106*b* is disposed on the head substrate 104 (the floating conductive plate 120). In addition, a through hole 118 becoming an ejection opening is formed in the ejection opening substrate 102 in a position in which the ink guide 106 is arranged. The ink guide 106 extends through the through hole 118 bored through the ejection opening substrate 102, and its tip portion 106*a* projects upwardly from the uppermost surface of the ejection opening substrate 102 on the recording medium P side (corresponding to the upper surface of the insulating layer 116*c* in FIGS. 3, and 4A and 4B). Note that in order to promote the concentration of the ink Q and the colored particle components contained in the ink Q at the tip portion 106*a*, a cutout serving as an ink guide groove through which the ink Q is collected at the tip portion 106*a* by a capillary phenomenon may be formed in a vertical direction in FIGS. 3, and 4A and 4B at the central portion of the ink guide 106.

Note that the tip portion 106*a* side of the ink guide 106 is formed into nearly a triangle (or a trapezoid) which tapers off towards the counter electrode side. A metal material is preferably evaporated onto the tip portion (the highest tip portion) 106*a* through which the ink Q is to be ejected. It should be noted that while the metal material is not necessarily evaporated onto the tip portion 106*a* of the ink guide 106, the evaporation of the metal material offers an effect that permittivity of the tip portion 106*a* of the ink guide 106 substantially increases to facilitate the generation of a strong electric field. The shape of the ink guide 106 is not especially limited as long as the ink Q, especially, the colored particle components contained in the ink Q, can be made to pass through the through hole 118 of the ejection opening substrate 102 to be concentrated at the tip portion 106*a*. For example, the tip portion 106*a* does not necessarily have the convex shape. Thus, the shape of the tip portion 106*a* may be freely changed. Alternatively, the tip portion 106*a* may have a conventionally known shape.

The head substrate 104 is disposed at a predetermined distance from the ejection opening substrate 102. Then, an ink passage 124 functioning as an ink reservoir (ink room) for supplying the ink Q to the ink guide 106 is defined between the head substrate 104 and the ejection opening substrate 102. Note that the ink Q within the ink passage 124 contains the colored particle components which are charged at the same polarity as that of the voltages applied to the first and second ejection electrodes 110 and 112, respectively. In recording an image, circulation means described below makes the ink Q circulate through the ink passage 124 in a predetermined direction (in a direction indicated by an arrow a within the ink passage 124, i.e., from the right-hand side to the left-hand side in the example shown in FIG. 4A) at a predetermined velocity (e.g., at an ink flow of 200 mm/s). Hereinafter, a description will be given as an example to a case where the colored particles contained in the ink Q are positively charged.

The first and second ejection electrodes 110 and 112 are ring-like circular electrodes which are each provided on the upper surface and the lower surface of the insulating substrate 108 in the figure while sandwiching the substrate so as to surround the periphery of the through hole 118 bored through the insulating substrate 108. In addition, the ink jet head 100 further includes the insulating layer 116*a* with which the lower side (lower surface) of the second ejection electrode 112 is covered, the sheet-like guard electrode 114 which is disposed above the first ejection electrode 110 through the insulating layer 116*b*, and the insulating layer 116*c* with which the upper surface of the guard electrode 114 is covered.

As shown in FIG. 3, a plurality of first ejection electrodes 110 disposed in a row direction (in a main scanning direction) are connected to one another, and a plurality of second ejection electrodes 112 disposed in a column direction (in a sub scanning direction) are also connected to one another.

Note that the first and second ejection electrodes 110 and 112 are not limited to the ring-like circular electrode type, and hence an electrode having any shape such as an enclosing electrode or a parallel electrode may be adopted for each of the first and second ejection electrodes 110 and 112 as long as the electrode is disposed so as to face the ink guide 106. For example, a nearly circular electrode, a split circular electrode, a parallel electrode, or a nearly parallel electrode may be adopted therefor.

The above-mentioned control means is connected to the first and second ejection electrodes 110 and 112 in order to apply signal voltages corresponding to an image signal to the first and second ejection electrodes 110 and 112, respectively. Thus, the control means includes a signal voltage source and the like. A method of driving the first and second ejection electrodes 110 and 112 by the control means will be described later.

In addition, the through hole 118 is bored so as to extend completely through the insulating layer 116*a* provided below the insulating substrate 108, and the insulating layer

116*b* and the insulating layer 116*c* provided above the insulating substrate 108. That is, the through hole 118 extends across a lamination member (the ejection opening substrate 102) including the insulating layer 116*a*, the insulating substrate 108, and the insulating layers 116*b* and 116*c*. In addition, the ink guide 106 is inserted from the insulating layer 116*a* side into the through hole 118, and the tip portion 106*a* of the ink guide 106 projects upwardly from the upper surface of the insulating layer 116*c*.

The guard electrode 114 is disposed on the upper side of the first ejection electrode 110 in FIGS. 4A and 4B, i.e., on the recording medium P side (refer to FIG. 1) through the insulating layer 116*b*. Also, the upper surface of the guard electrode 114 is covered with the insulating layer 116*c*. The guard electrode 114 is disposed between the adjacent first ejection electrodes 110 in order to suppress an electric field interference generated between the ink guides 106 serving as the ejection portions, by the adjacent ejection electrodes in response to a predetermined constant voltage applied thereto. In the illustrated example, the guard electrode 114 is grounded, and thus 0 V is set. In addition, the guard electrode 114 is a sheet-like electrode formed of a metal plate or the like common to the ejection portions. Then, the opening portions corresponding to the first or second ejection electrodes 110 or 112 formed in the peripheries of the through holes 118 for the respective ejection portions which are two-dimensionally disposed are bored through the guard electrode 114.

In addition, to shield against a repulsion electric field in a direction from the first or second ejection electrode 110 or 112 to the ink passage 124, a shielding electrode may be suitably provided on the passage side of the first and second ejection electrodes 110 and 112. In this case, as will be described later, to make the colored particle components contained in the ink Q migrate to the ejection opening substrate 102 side, a suitable voltage may be applied across the shielding electrode and the floating conductive plate.

The floating conductive plate 120 is disposed below the ink passage 124, and is in an electrically insulating state (in a high impedance state). In the example shown in FIGS. 4A and 4B, the floating conductive plate 120 is disposed on the upper surface of the head substrate 104. It should be noted that in the present invention, the floating conductive plate 120 may be disposed in any position as long as the floating conductive plate 120 is located below the ink passage 124. For example, the floating conductive plate 120 may be disposed inside or below the head substrate 104, or disposed on an upstream side of the ink passage 124 with respect to the position of the ejection electrode (the first or second ejection electrode 110 or 112) and inside the head substrate 104.

In recording an image, an induced voltage is generated in the floating conductive plate 120 based on voltage values applied to the respective ejection electrodes. Thus, the floating conductive plate 120 serves to make the colored particle components contained in the ink Q within the ink passage 124 migrate to the ejection opening substrate 102 side to concentrate the colored particle components by the induced voltage. Consequently, the floating conductive plate 120 must be disposed on the head substrate 104 side with respect to the ink passage 124. In addition, the floating conductive plate 120 is preferably disposed on an upstream side of the ink passage 124 with respect to the positions of the ejection electrodes.

The concentration of the colored particle components in an upper layer of the ink Q within the ink passage 124 is increased by the operation of the floating conductive plate 120. Here, the concentration of the colored particle components within the ink Q passing through the through hole 118 of the ejection opening substrate 102 can be increased up to predetermined concentration. Thus, the colored particle components within the ink Q can be concentrated at the tip portion 106*a* of the ink guide 106 to stabilize the concentration of the colored particle components within the ink Q to be ejected in the form of an ink droplet to predetermined concentration.

In addition, by providing the floating conductive plate 120, the induced voltage in the floating conductive plate 120 changes based on the number of operation channels. Hence, the colored particles required for the ejection are supplied even when the voltage induced in the floating conductive plate 120 is not controlled, so the clogging can be prevented. Note that a power source is connected to the floating conductive plate 120 to apply a predetermined voltage to the floating conductive plate 120.

One or more floating conductive plates 120 are provided per head unit. For example, in case of the full-color printing, when four head units are provided for cyan (C), magenta (M), yellow (Y), and black (B), each of the four heads has at least one floating conductive plate, and thus it is avoided to provide one floating conductive plate common to the four head units.

The electrostatic type ink jet head 100 is basically constructed as described above.

Hereinafter, an operation of the electrostatic type ink jet head 100 will be described with reference to FIGS. 3, 4A and 4B, and 5A to 5C.

In the ink jet head 100 constructed as described above, the ink Q passes through the through hole 118 from the ink passage 124 to be supplied to the tip portion 106*a* and an ink meniscus is formed at the tip portion 106*a* by the electrostatic field generated between the vicinity of the tip portion 106*a* and the recording medium P charged with negative. Then, the colored particles contained in the ink Q and charged with positive are concentrated in the vicinity of the tip portion 106*a* by the electrostatic force.

When predetermined positive voltages corresponding to an image signal are applied to the first and second ejection electrodes 110 and 112, respectively, by the control means, the ink Q containing the positively charged colored particles charged and concentrated at the tip portion 106*a* is ejected in the form of an ink droplet having a predetermined size to be attracted and flown towards the recording medium P (not shown) disposed in a position facing the ink jet head 100. All the ink droplets are then stuck onto respective predetermined positions on the recording medium P to form an image.

Next, an example of a drive form of the first and second ejection electrodes 110 and 112 will hereinafter be described in detail.

As described above, in the ink jet head 100, a plurality of first ejection electrodes 110 disposed in a row direction (in a main scanning direction) are connected to one another, and a plurality of second ejection electrodes 112 disposed in a column direction (in a sub scanning direction) are also connected to one another. Then, the first and second ejection electrodes 110 and 112 are each of a two-layer electrode structure and are disposed in matrix.

In recording an image, in this embodiment, the first ejection electrodes 110 are successively set row by row to a high voltage level or a high impedance state (an ON-state), and all the remaining first ejection electrodes 110 are set to the ground level (in the ground state: in an OFF-state). In addition, the second ejection electrodes 112 are driven in columns at a high voltage level or at the ground level based on the image data. As a result, the ejection/non-ejection of the ink in respective ejection portions is controlled.

That is to say, when the first ejection electrode 110 is at the high voltage level or in the floating state, and at the same time, the second ejection electrode 112 is at the high voltage level, the ink is ejected. On the other hand, when one of the first and second ejection electrodes 110 and 112 is at the ground level, no ink is ejected.

Note that as another embodiment, the first and second ejection electrodes 110 and 112 may be driven in a reverse state of the foregoing.

In this embodiment, there may be adopted such an operation that when the voltage levels of the first and second ejection electrodes 110 and 112 become high after pulse voltages are applied to both the ejection electrodes based on the image signal, the ink is ejected.

For example, when it is supposed that the colored particle components contained in the ink Q is positively charged in the ink jet head 100, the ink Q is made to circulate through the ink passage 124 of the ink jet head 100 in the direction indicated by the arrow a, and an electric field permitting the positively charged colored particles in the ink Q (ink droplet) ejected from the tip portion 106*a* of the ink guide 106 of the ejection portion to be attracted towards the recording medium P, i.e., a flight electric field is generated between the first and second ejection electrodes 110 and 112, and the recording medium P. For example, a distance (gap) between the tip portion 106*a* of the ink guide 106 and the recording medium P is generally in a range of 200 to 1,000 μm. When the gap is 500 μm, a potential difference of 1.0 to 2.5 kV is produced therebetween to generate the flight electric field.

Moreover, when an average voltage is applied to the first or second ejection electrode 110 or 112, an induced voltage lower than the average voltage is nearly stationarily induced in the floating conductive plate 120. Hence, an electric field (hereinafter referred to as "migration electric field" for example) permitting the positively charged colored particles contained in the ink Q within the ink passage 124 serving as the ink reservoir to be upwardly attracted is produced to unevenly distribute the positively charged colored particles within the ink Q in the upper portion of the ink passage 124. For example, a potential difference of about several hundreds of volts is produced for the ink passage 124 having a depth of several millimeters to form the migration electric field.

For example, the recording medium P is charged at a negative high voltage of −1.5 kV (or the counter electrode (the conveyance belt 32 or the recording medium P) is biased at −1.5 kV), and both the first and second ejection electrodes 110 and 112 are set at 0 V (in the grounding state) to produce the flight electric field. In this case, the guard electrode 114 is set at 0 V (in the grounding state).

At this time, the ink Q rises in a space defined between the through hole 118 and the ink guide 106 from the ink passage 124 to be collected at the tip portion 106*a* to form an ink meniscus by the electrophoresis phenomenon and the capillary phenomenon. The ink Q collected at the tip portion 106*a* is restrained at the tip portion 106*a* by a surface tension or the like of the ink Q, and thus the positively charged colored particles contained in the ink Q are concentrated at the tip portion 106*a*.

Next, pulse-like drive voltages of 400 to 600 V for example are applied to the first and second ejection electrodes 110 and 112, respectively, based on an image signal to eject the ink droplet containing the highly concentrated and positively charged colored particles from the tip portion 106*a* of the ink guide 106. When initial particle concentration of the ink Q is in a range of 3 to 15%, for example, the particle concentration of the ejected ink droplet is preferably equal to or higher than 30%. Note that while a pulse width of the pulse-like drive voltage is not especially limited, for example, the pulse width may be in a range of several tens of microseconds to several hundreds of microseconds. In addition, a diameter of a dot recorded on the recording medium P depends on magnitude or an application time period of the pulse voltage.

Note that in the ink jet head 100 according to this embodiment, there is no particular limitation as to whether the ejection/non-ejection of the ink Q is controlled using one of or both of the first and second ejection electrode 110 or 112. However, it is preferable that when one of the first and second ejection electrodes 110 and 112 is brought into the ground level, no ink Q is ejected, and only when the first ejection electrode 110 is either in a high impedance state or at a high voltage level, and at the same time the second ejection electrode 112 is at a high voltage level, the ink Q is ejected.

Now, while in the ink jet head 100 according to this embodiment, as in the illustrated example, the guard electrode 114 is provided between the adjacent first ejection electrodes 110, the present invention is not intended to be limited thereto. There may be adopted such a constitution that in a case where the first and second ejection electrodes 110 and 112 are matrix-driven, for example, the second ejection electrodes 112 below the first ejection electrodes 110 are successively driven column by column, and in a case where the first ejection electrodes 110 above the second ejection electrodes 112 are driven based on image data, the guard electrode is provided between the first ejection electrodes 110 only in the row direction. In such a case as well, in recording an image, the guard electrode 114 is biased at a predetermined guard electric potential, e.g., at the ground level or the like, thereby excluding the influences of the electric fields generated between the adjacent ejection portions.

In addition, in a case where when the first and second ejection electrodes 110 and 112 are driven, the first ejection electrodes 110 as the upper layer are successively turned ON row by row, and the second ejection electrodes 112 as the lower layer are turned ON/OFF based on image data, i.e., in a case where when the first and second ejection electrodes 110 and 112 are driven in a state in which the arrangement of the matrix is reversed, the second ejection electrodes 112 are driven based on the image data. Thus, the levels of the ejection electrodes on both the sides of the center ejection electrodes in the column direction frequently changes into a high voltage level or the ground level.

However, with respect to the row direction, the first ejection electrodes 110 are driven row by row, and the levels of the first ejection electrodes 110 on both the sides of each central ejection electrode row are always brought into the ground level. Thus, the first ejection electrodes 110 on both the rows function as the guard electrodes. In the case where the first ejection electrodes 110 as the upper layer are successively turned ON row by row, and the second ejection electrodes 112 as the lower layer are driven based on the image data, even if no guard electrode 114 is provided, the influences of the adjacent ejection electrodes can be excluded to enhance the recording quality.

In this embodiment of the electrostatic type ink jet head including the ejection electrodes having the two-layer electrode structure, there may be adopted such an operation that when the counter electrode (the recording medium P) is charged at −2.1 V for example, and one of or both of the first and second ejection electrodes are at the negative high voltage (e.g., at −600 V), no ink Q is ejected, and only when both of the first and second ejection electrodes are at the ground level (at 0 V), the ink Q is ejected.

In addition, while in this embodiment, the two-layer electrode structure including the first and second ejection electrodes 110 and 112 in the individual ejection portions is adopted, and the ink jet head can be stably driven in accordance with the above-mentioned driving methods, the ink jet head of the present invention is not intended to be limited thereto. The ejection electrodes may also be of a single layer electric structure, or of three or more layer electrode structure.

The ink jet head 100 of the present invention is basically as described above.

Here, in the recording head 70 shown in FIG. 2, the ejection portions in the ink jet head 100 are disposed nearly in parallel with the conveyance direction of the recording medium P.

In this embodiment, the serial scanning is carried out in which the process is repeatedly performed which includes ejecting the ink droplets while the main scanning is carried out for the recording medium P with the recording head 70 in a direction intersecting perpendicularly the conveyance direction of the recording medium P along the guide rails 84*a* and 84*b*, and thereafter moving the recording medium P only by a given amount of conveyance. The serial scanning is carried out in such a manner, thereby recording an image.

In addition, the ink ejection portions of the respective ink jet heads are disposed in a position corresponding to the position where the conductive platen 36 is disposed and facing the surface of the conveyance belt 32 at a predetermined distance from the surface of the recording medium P which is conveyed while electrostatically attracted on the surface of the conveyance belt 32.

The position detector 52 for detecting a position of the recording medium P is conventionally known position detection means composed of a photo-sensor or the like. The position detector 52 is disposed in a position between the charger 38 and the ink jet head (recording head) 70 along the conveyance path for the recording medium P. In this case, this position where the position detector 52 is disposed faces the surface of the conveyance belt 32 by which the recording medium P is conveyed.

A position of the recording medium P is detected by the position detector 52, and the resultant positional information is supplied to the head driver 50. The head driver 50 is installed on the right-hand surface of the inside of the casing 22 in FIG. 1, and is connected to the recording head 70 of the head unit 48.

The image data from an external device as well as the positional information of the recording medium P from the position detector 52 are inputted to the head driver 50. The ink is ejected from the ejection head based on image data while the ejection timings of the ink jet head 100 (refer to FIGS. 3, 4A and 4B, and 5A to 5C) of the recording head 70 are controlled based on the positional information of the recording medium P with the control made by the head driver 50. Thus, a color image corresponding to the image data is recorded on the recording medium P.

Next, the ink circulation means 18 will hereinafter be described.

The ink circulation means 18 includes the ink tank 54, the ink disposal tank 56, the ink supply sub-tank 72, the ink recovery/disposal sub-tank 74, a pump (not shown), an ink supply passage 58, an ink recovery passage 60, an ink disposal passage 62, and an ink passage 80.

As shown in FIG. 1, the ink tank 54 is connected to the head unit 48 (including the ink supply sub-tank 72 and the ink recovery/disposal sub-tank 74) through the ink supply passage 58 and the ink recovery passage 60. Also, the ink disposal tank 56 is connected to the head unit 48 (including the ink recovery/disposal sub-tank 74) through the ink disposal passage 62.

The charged fine particle-containing ink (colored particles) and the dispersion medium for dispersion of the charged particles is stored in the ink tank 54. The ink stored in the ink tank 54 is supplied to a tank of the ink supply sub-tank 72 through the ink supply passage 58 by the pump.

In addition, the ink not used in the recording head 70 (the colored particle-containing ink not ejected from the recording head 70) is recovered into the ink tank 54 through the ink recovery passage 60. In such a manner, the ink is made to circulate to be supplied to the recording head 70.

In addition, the ejection of the ink from the recording head 70 decreases the concentration of the ink circulating in the ink circulation means 18. Hence, it is preferable that the ink circulation means 18 detects the concentration of the ink with an ink concentration detector (not shown), and replenishes suitably with the ink from an ink tank for supply based on the detected ink concentration to hold the ink concentration in a predetermined range.

In addition, the ink tank 54 is preferably provided with a stirrer for suppressing precipitation and concentration of the solid components of the ink, and an ink temperature control device for suppressing a change in temperature of the ink. This is because if the temperature of the ink is not controlled, the ink temperature may vary due to a change or the like of the environmental temperature, and hence the physical properties of the ink vary to change the dot diameters of the ink droplets, thereby impeding the stable formation of a high quality image. It is possible to use a moving vane, an ultrasonic vibrator, a circulating pump or the like as the stirrer.

As a method for controlling a temperature of the ink, it is possible to use a known method in which a heating element such as a heater or a cooling element such as a Peltier element is disposed on the recording head 70, the ink tank 54, the ink passage or the like to control a temperature of the ink using various kinds of temperature sensors (a thermostat and the like).

The ink disposal tank 56 stores therein the ink which is discarded from the ink recovery/disposal sub-tank 74 through the ink disposal passage 62. In addition, the ink disposal tank 56 is preferably of an exchangeable cartridge type.

Next, the ink circulation means disposed around the recording head 70 will hereinafter be described in detail with reference to FIG. 2.

In the head unit 48 shown in FIG. 2, as described above, the recording head 70, the ink supply sub-tank 72, the ink recovery/disposal sub-tank 74, and sub-tank position adjustment mechanisms 76 and 78 (on the ink supply sub-tank 72 side and the ink recovery/disposal sub-tank 74 side, respectively) for vertically moving those sub-tanks 72 and 74 on the support member 86 are disposed on the plate-like support member 86.

The ink supply sub-tank 72 and the ink recovery/disposal sub-tank 74 are connected to ink tank 54 through the ink supply passage 58 and the ink recovery passage 60. These sub-tanks 72 and 74 are also connected to the recording head 70 through the ink supply passage 58*a* and the ink passage 80. The ink recovery passage 60*b* shows a drain tube extending from the ink supply sub-tank 72 to the ink tank 54. The ink recovery passage 60*a* shows a drain tube extending from the ink recovery/disposal sub-tank 74 to the ink tank 54. The ink disposal passage 62 shows a drain tube extending from the ink recovery/disposal sub-tank 74 to the ink disposal tank 56.

The ink supply sub-tank 72 supplies the ink supplied from the ink tank 54 through the ink supply passage 58, to the recording head 70 through the ink supply passage 58*a*. Here, the ink excessively supplied to the ink supply sub-tank 72 is made to pass through the ink recovery passage 60*b* by utilizing a hydrostatic pressure to be recovered into the ink tank 54. As a result, an amount of ink within the ink supply sub-tank 72 is held constant.

The recording head 70 records an image on the recording medium P using the ink supplied thereto, and the ink not used in the recording head 70 is recovered into the ink recovery/disposal sub-tank 74 through the ink passage 80.

The ink recovery/disposal sub-tank 74 supplies the ink recovered thereinto to the ink tank 54 and the ink disposal tank 56 through the ink recovery passage 60 and the ink disposal passage 62, respectively.

Here, the ink supply sub-tank 72 and the ink recovery/disposal sub-tank 74 are vertically moved by the sub-tank position adjustment mechanisms 76 and 78, respectively, to adjust a pressure applied to the recording head 70.

In addition, as described above, the ink recovered into the ink tank 54 is made to circulate to be supplied to the recording head 70 through the ink supply passage 58 again.

It should be noted that the present invention is not limited to the example as shown in which the ink recovered into the ink recovery/disposal sub-tank 74 is returned to the ink tank 54 through the ink recovery passage 60 for circulation. The ink flowing out of the recording head 70 into the sub-tank 74 may be collected in an ink collection tank through an ink collection passage by omitting the ink recovery passage 60*a* and replacing the ink disposal passage 62 and the ink disposal tank 56 with the ink collection passage and the ink collection tank, respectively. In that case, the ink collected in the ink collection tank may be discarded or, alternatively, returned to the ink tank 54 as such or after the colored particles of smaller diameters are removed from the ink by a particle diameter distribution narrowing means. It is also possible to replenish the collected ink as such, or the ink from which smaller particles have been removed, with colored particles or concentrated ink before the ink is returned to the ink tank 54.

In this embodiment, as described above, the ink jet head 100 is provided with the floating conductive plate 120, and also the recording medium P is charged at a predetermined voltage, and so forth, whereby the force acts on the colored particles as the solid components dispersed in the carrier liquid so that the concentration of the colored particle components within the ink passing through the through hole is increased, thereby making the ink Q fly in the form of an ink droplet. Thus, it is possible to eject the concentrated ink droplet.

As a result, an image recorded on the recording medium P has less bleeding. Moreover, an image can be recorded on various recording media P such as not only a plain paper but also a nonabsorbent film (such as a PET film). In addition, an image with high image quality can be recorded on various recording media without bleeding and flowing thereon.

Figure 6:
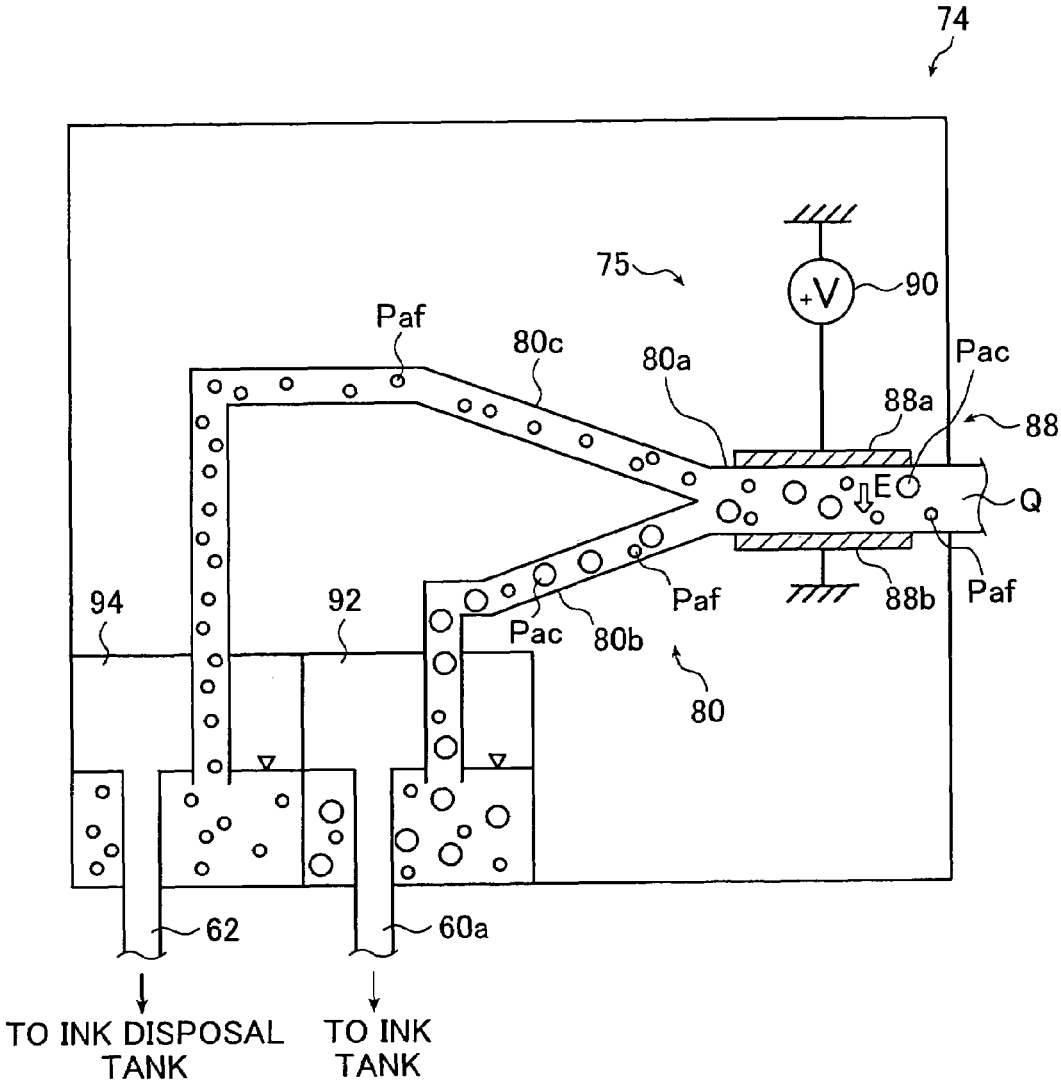
FIG. 6 is a schematic enlarged view of an ink recovery/disposal sub-tank of the electrostatic type ink jet recording apparatus according to the embodiment of the present invention.

Moreover, in this embodiment, in order that the particle diameter distribution of the colored particles in the ink to be supplied to the recording head 70 may be further narrowed to be brought close to a predetermined value, and also the solvent (diluent) containing unnecessary particles having small particle diameters may be reutilized, the ink recovery/disposal sub-tank 74 is provided with particle diameter distribution narrowing means 75 as shown in FIG. 6.

The ink recovery/disposal sub-tank 74 provided with the particle diameter distribution narrowing means 75 shown in FIG. 6 will hereinafter be described in detail.

The ink recovery/disposal sub-tank 74 includes the particle diameter distribution narrowing means 75, an ink recovery sub-tank 92, and an ink disposal sub-tank 94.

In addition, the particle diameter distribution narrowing means 75 includes an ink passage 80 having a main tube 80*a* and branch tubes 80*b* and 80*c*, parallel electrodes 88 having two electrode plates 88*a* and 88*b*, and a voltage source 90.

The ink passage 80 includes the main tube 80*a*, and the two branch tubes 80*b* and 80*c* branching in a Y shape from the main tube 80*a*. In addition, one end (opposite side to the branch tubes 80*b* and 80*c*) of the main tube 80*a* is connected to the recording head 70 (refer to FIG. 2). In addition, the branch tube 80*c* is connected to the ink disposal sub-tank 94 and the branch tube 80*b* is connected to the ink recovery sub-tank 92. In addition, the ink recovery sub-tank 92 is connected to the ink recovery passage 60*a* to make uniform a level of the ink stored therein by utilizing the hydrostatic pressure similarly to the case of the ink supply sub-tank 72. The ink disposal sub-tank 94 is connected to the ink disposal passage 62 to make uniform a level of the ink stored therein by utilizing the hydrostatic pressure similarly to the case of the ink recovery sub-tank 92.

The parallel electrodes 88 are disposed so as to sandwich the main tube 80*a*. Here, an electrode plate 88*a* on a side of voltage application (an upper electrode in FIG. 6) is connected to a voltage source 90 for applying a voltage to the electrode plate 88*a*, and a ground electrode plate 88*b* (a lower electrode in FIG. 6) is grounded. That is to say, the parallel electrodes 88 are used to generate an electric field (indicated by an arrow E in FIG. 6) within the main tube 80*a*.

In addition, the voltage source 90 is preferably a variable voltage source which can change a value of the applied voltage.

As described above, the ink Q is supplied from the recording head 70 to flow from the main tube 80*a* into the branch tubes 80*b* and 80*c*. When the ink Q flows through the main tube 80*a* to reach a portion of the main tube 80*a* in which the parallel electrodes 88 are disposed, forces (indicated by the arrow E in FIG. 6) are applied to the positively charged colored particles Pa in the flowing ink Q by an electric field formed by the parallel electrodes 88 so that the charged colored particles Pa moves downwardly in the figure through the electrophoresis. In this connection, the forces applied to the colored particles Pa are different depending on the particle diameters (actually, masses) of the colored particles Pa. Thus, as the particle diameters of the colored particles Pa are larger, the forces downwardly applied to the colored particles Pa become larger, and hence an amount of downward movement (towards the ground electrode plate 88*b*) of the colored particles through the electrophoresis becomes larger.

As a result, of the colored particles Pa within the main tube 80*a*, the colored particles Pac having particle diameters each larger than a predetermined particle diameter flow into the branch tube 80*b* on the lower side in the figure, and the colored particles Paf having particle diameters each smaller than the predetermined particle diameter flow into the branch tube 80*c* on the upper side in the figure. In such a manner, classification of the colored particles can be performed.

The ink Q within the branch tube 80*b* after the classification is supplied to the ink recovery sub-tank 92, and the ink Q within the branch tube 80*c* is supplied to the ink disposal sub-tank 94.

Then, as described above, the ink Q stored in the ink recovery sub-tank 92 is recovered into the ink tank 54 through the ink recovery passage 60*a*, while the ink Q stored in the ink disposal sub-tank 94 is discarded into the ink disposal tank 56.

According to this embodiment, as described above, the colored particles having small particle diameters which are hardly ejected and concentrated are removed using the particle diameter distribution narrowing means 75, whereby even when the continuous recording is carried out for a long time, it is possible to supply the colored particles which have a narrow particle diameter distribution, and hence whose diameters are more uniform. Hence, an image with high image quality can be stably drawn without frequently exchanging the ink for another and irrespective of the recording medium.

Here, an amount of movement of particles can be controlled by changing a voltage applied across the parallel electrodes 88. Hence, it is also possible to control a threshold for the particle diameters of the particles which flow into the branch tubes 80*b* and 80*c*, respectively, after the classification of the particles. Controlling the threshold in such a manner allows the particle diameter distribution to be controlled. As a result, it is also possible to control the density gradation.

In addition, while in this embodiment, the particle diameter distribution narrowing means 75 is disposed in the ink recovery/disposal sub-tank 74, the position of the particle diameter distribution narrowing means 75 to be provided is not especially limited. Thus, the particle diameter distribution narrowing means 75 may be disposed in any position such as a position between the ink supply passage 58 and the ink supply sub-tank 72 or any of passages before and behind the recording head 70.

In addition, the particle diameter distribution narrowing means 75 may also be directly connected to the ink tank 54.

Referring back to FIG. 1, a supplementary description will hereinafter be given with respect to other portions of the ink jet recording apparatus.

The solvent collection means 20 serves to recovery the dispersion medium evaporating from the ink ejected from the recording head 70 onto the recording medium P, the dispersion medium evaporating from the ink during image fixation, and the like. The solvent collection means 20 includes an exhaust fan 64, and an activated carbon filter 66. The activated carbon filter 66 is mounted on an upper rear surface (on the upper side in the figure) of the casing 22, and the exhaust fan 64 is mounted onto the activated carbon filter 66.

The air containing the dispersion medium components in the inside of the casing 22 is exhausted to the outside of the casing 22 through the activated carbon filter 66 by the exhaust fan 64. During the exhaust of the air, the dispersion medium components contained in the air in the inside of the casing 22 are attracted and removed by the activated carbon filter 66.

A characteristic operation of the electrostatic type ink jet recording apparatus 10 according to this embodiment as constructed as above will hereinafter be described.

In the electrostatic type ink jet apparatus 10, in recording an image, the recording media P accommodated in the sheet feeding tray 24 are taken out one by one by the feed roller 26 to be held and conveyed by the conveyance roller pair 30. Each sheet of the recording medium P thus conveyed is then supplied to a predetermined position on the conveyance belt 32.

The recording medium P supplied to the conveyance belt 32 is then charged at a negative high voltage by the charger 38 to be electrostatically attracted on the surface of the conveyance belt 32.

An image corresponding to the image data is recorded on the surface of the recording medium P, which is electrostatically attracted on the surface of the conveyance belt 32, by the recording head 70 while the recording medium P is moved at a predetermined constant speed along with the movement of the conveyance belt 32.

The recording medium P after the image has been recorded thereon is discharged by the discharger 40, and is then separated from the conveyance belt 32 by the separation claw 42 to be supplied to the fixing roller pair 46 along the guide 44. Then, the recorded image on the recorded medium P is heated and fixed while the recording medium P is held and conveyed by the fixing roller pair 46. The resultant sheets each having an image recorded thereon are stocked on top of one another within the discharge tray 28.

During the recording of an image, the ink Q is supplied from the ink tank 54 to the recording head 70 through the ink supply passage 58 and the ink supply sub-tank 72. The ink Q not used in the recording head 70 is recovered into the ink recovery/disposal sub-tank 74. In addition, the colored particles Pa contained in the ink Q are classified into the colored particles Pac each having a particle diameter larger than the predetermined particle diameter and the colored particles Paf each having a particle diameter smaller than the predetermined particle diameter by the particle diameter distribution narrowing means 75 provided in the ink recovery/disposal sub-tank 74. Then, the colored particles Pac are returned back to the ink tank 54 through the ink recovery passage 60, while the colored particles Paf are discarded into the ink disposal tank 56 through the ink disposal passage 62.

Optical means, magnetic means, and electrical means for detecting the concentration of the charged fine particles in the ink Q are disposed in the ink tank 54, the ink supply passage 58, the ink recovery passage 60, or the head unit 48, and means for replenishing with the fine particles is further provided. With the replenishment means, supply of the dispersion medium for the fine particles of high concentration, supply of the high concentration ink containing a charging control agent, and the like are suitably carried out based on the detection results. It is also possible to replenish with the dispersion medium in consideration of the evaporation of the ink dispersion medium. The ink concentration and the ink amount are held constant by those means.

The colored particles having small particle diameters which are hardly ejected are removed through the classification in such a manner, thereby suppressing a change in particle diameter distribution of the colored particles in the ink Q supplied to the recording head 70. As a result, even when the continuous recording is carried out for a long time, the colored particles are stably concentrated, and the ejection state is also stabilized. Thus, it is possible to obtain an effect that an image with high image quality can be stably recorded.

A change in particle diameter distribution of the colored particles is suppressed, so that it is unnecessary to frequently exchange the ink for another. Further, even when relatively inexpensive ink having large particle diameter distribution of colored particles is used, the particle diameter distribution can be narrowed to make the particle diameters of the colored particles more uniform. Thus, it is possible to record an image with high image quality.

While in the above-mentioned example, the description has been given to the ink jet recording apparatus in which the colored particles in the ink are positively charged, and the recording medium or the counter electrode on the rear side of the recording medium is charged at a negative high voltage, and under this condition, an image is recorded with ejected ink droplets, the present invention is not intended to be limited to this operation. Conversely, such an operation may be adopted that the colored particles in the ink are negatively charged, and the recording medium or the counter electrode is charged at a positive high voltage, and under this condition, an image is recorded with ejected ink droplets. In a case where the polarity of the colored particles is inverted to that of the above-mentioned example, the polarities of the applied voltages to the parallel electrodes of the particle diameter distribution narrowing means, the electrostatic attraction means, the counter electrode, and the ejection electrodes of the electrostatic type ink jet head have only to be inverted to those in the above-mentioned example.

Next, another embodiment of the present invention will hereinafter be described.

The embodiment described below relates to an improved construction of the particle diameter distribution narrowing means.

Figure 7:
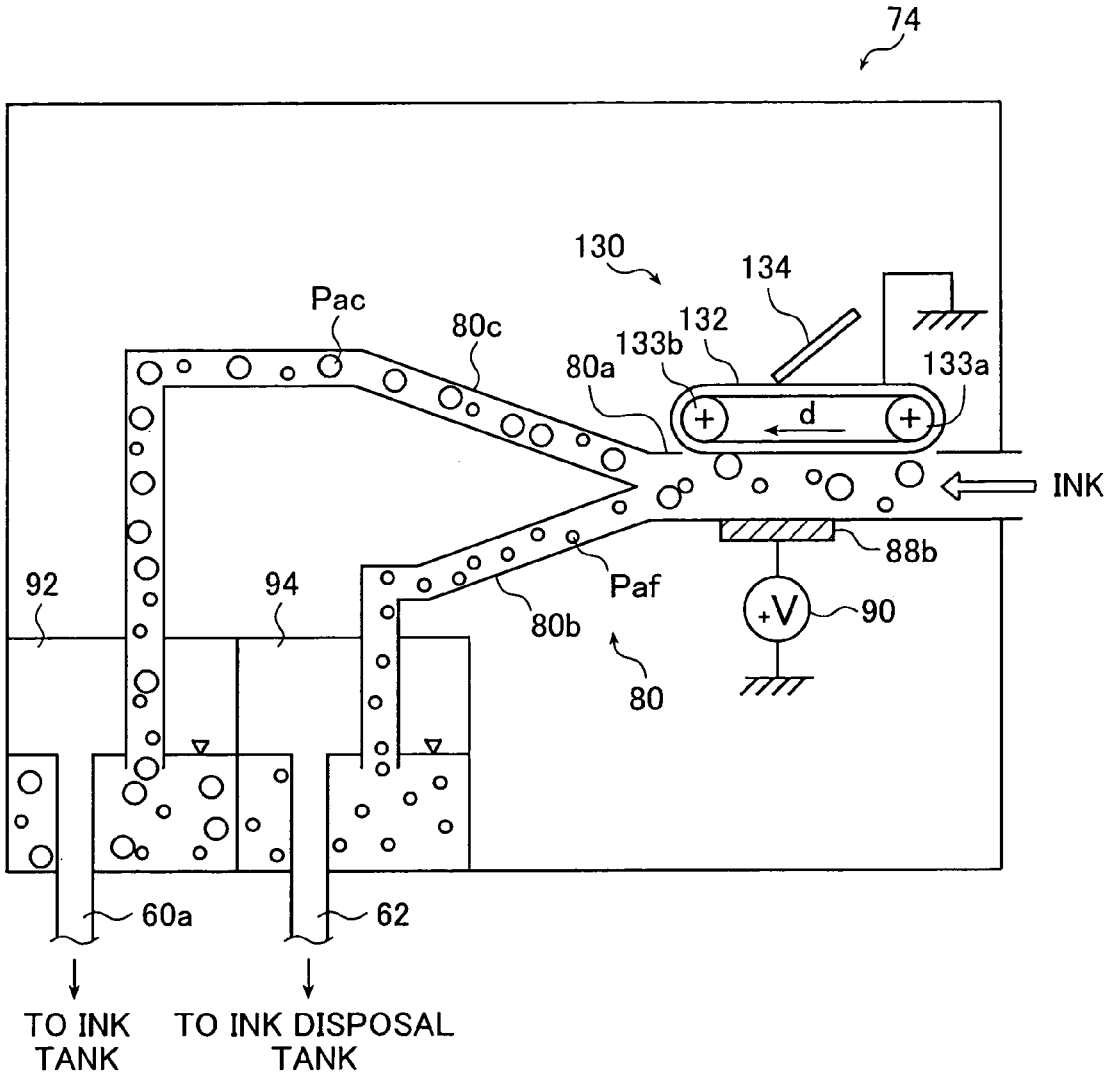
FIG. 7 is a schematic enlarged view of an ink recovery/disposal sub-tank of an electrostatic type ink jet recording apparatus according to another embodiment of the present invention.

FIG. 7 is an enlarged schematic view showing an ink recovery/disposal sub-tank 74 including particle diameter distribution narrowing means 130 according to this embodiment. The feature of the particle diameter distribution narrowing means 130 according to this embodiment is that an upper surface, of the main tube 80*a* of the ink passage 80, in a portion having the particle diameter distribution narrowing means 130 according to this embodiment provided therein is cut away to be opened, and one (a negative side electrode to which the particles are attracted) of electrodes for the classification is disposed in the form of a rotating type belt electrode 132 in the upper surface thus cut away in that portion so as to face the other electrode 88*b*.

The rotating type belt electrode 132 is suspended between two belt rollers 133*a* and 133*b* connected to a drive source (not shown) and is adapted to be rotated in a direction indicated by an arrow d. In addition, a blade 134 for scraping off the colored particles adhered to the surface of the rotating type belt electrode 132 based on its operation which will be described layer is provided so as to be brought into contact with an upper surface of the rotating type belt electrode 132. It should be noted that this blade 134 is preferably made of a corrosion resistant material having suitable elasticity (e.g., formed of a plate member made of fluororesin).

The rotating type belt electrode 132 is preferably made of a corrosion resistant material having a conductivity (such as a stainless belt or fluororesin containing carbon particles dispersed therein). When the rotating type belt electrode 132 is made of a material other than a fluororesin, it is also preferable to coat a surface of this material with a fluorine coating in order to facilitate the peeling-off of the colored particles stuck to the surface of the rotating type belt electrode 132.

As described above, in the particle diameter distribution narrowing means 130 according to this embodiment, the upper surface of the main tube 80*a* of the ink passage 80 is cut away to be opened. However, since a flow velocity of the ink Q flowing through the main tube 80*a* is not very high, and the ink Q has a surface tension, there is no possibility that the ink Q overflows from this opened portion (actually, a gap defined between a peripheral portion of the rotating type belt electrode 132 and the periphery of the cut away portion of the main tube 80*a*).

In addition, except the above-mentioned portion of the particle diameter distribution narrowing means 130, this embodiment has the same construction as that in the embodiment previously described with reference to FIG. 6. Thus, the same components as those shown in FIG. 6 are identified by the same reference numbers, and their detailed descriptions are omitted here for the sake of simplicity.

An operation of the particle diameter distribution narrowing means 130 according to this embodiment constructed as described above will hereinafter be described.

While an image is recorded on the recording medium P, the ink Q is supplied from the ink tank 54 to the recording head 70 through the ink supply passage 58 and the ink supply sub-tank 72. The ink not used in the recording head 70 is recovered into the ink recovery/disposal sub-tank 74. In addition, the colored particles Pa contained in the ink Q are classified into the colored particles Pac each having a particle diameter larger than the predetermined particle diameter and the colored particles Paf each having a particle diameter smaller than the predetermined particle diameter by the particle diameter distribution narrowing means 130 provided in the ink recovery/disposal sub-tank 74. Then, the colored particles Pac are returned back to the ink tank 54 through the ink recovery passage 60, while the colored particles Paf are discarded into the ink disposal tank 56 through the ink disposal passage 62.

In this connection, in the particle diameter distribution narrowing means 130, the colored particles contained in the ink Q are classified based on the principle as described above by applying a predetermined voltage from a voltage source 90 to the lower electrode plate 88*b* of the parallel electrodes 88. In the particle diameter distribution narrowing means 130 according to this embodiment, the counter electrode is constructed in the form of the rotating type belt electrode 132. Hence, even when the colored particles energized by the electric field are stuck (i.e. electrically deposited) to the rotating type belt electrode 132, the surface of the rotating type belt electrode 132 can be always maintained in a preferable state by scraping off the stuck colored particles with the above-mentioned blade 134.

That is to say, when the colored particles are stuck to the surface of the rotating type belt electrode 132, intensity of the electric field generated between the rotating type belt electrode 132 and the electrode plate 88*b* may be reduced so that the sufficient classification of the colored particles cannot be performed. However, the particle diameter distribution narrowing means 130 according to this embodiment scrapes off particles stuck thereto by means of the blade 134 to prevent the above situation, whereby the colored particles can be continuously classified in a consistent manner.

As a result, it becomes possible to suppress a change in particle diameter distribution of the colored particles in the ink Q supplied to the recording head 70, and hence the colored particles can be stably concentrated and the state of ejection is also stabilized even if images are continuously recorded for a long time. Therefore, it is possible to record high quality images stably.

Since it is possible to suppress a change in particle diameter distribution of the colored particles, frequent exchange of ink is not necessary. Further, even if relatively inexpensive ink having a large particle diameter distribution of colored particles is used, the particle diameter distribution can be narrowed to make the particle diameters of the colored particles more uniform, which results in that an image with high image quality can be recorded.

Colored particles stuck to the surface of the rotating type belt electrode 132 and scraped off with the blade 134 is preferably returned back to the ink Q by utilizing a suitable method before the quantity of the scraped colored particles remaining on the surface of the belt electrode 132 is increased so much. Therefore, the blade 134 is preferably disposed so as to be brought into contact with the lower surface of the rotating type belt electrode 132 (i.e., in the ink Q) in order to substantially prevent the colored particles to be stuck.

In the particle diameter distribution narrowing means 130 according to this embodiment, one of the electrodes for the classification is constructed in the form of the rotating type belt electrode 132 as described above, thereby substantially preventing the colored particles from being stuck to the surface of the electrode. Thus, there is offered an effect that the ink Q can be stably supplied for a long time period, and hence an image with high image quality can be stably recorded.

While in the above description, the specific case where a monochrome image is recorded is given as an example, the present invention is not intended to be limited to that specific case, and hence the full color printing using four colors of cyan (C), magenta (M), yellow (Y), and black (B) may also be carried out. In this case, head units may be provided for the respective colors, or ink jet heads for the respective colors may also be provided collectively in one recording head.

In addition, while in this embodiment, there is shown the example in which the serial head type head unit is used, the present invention is not intended to be limited to that example. For example, any of head units such as a line head type head unit may be used.

That is to say, it is to be understood that since the above-mentioned embodiments only show examples of the present invention, the present invention should not be limited to those examples, and hence suitable changes or improvements may be made within the range not departing from the subject matter of the present invention.

What is claimed is:

1. An ink jet recording apparatus, comprising:

an ink jet head for causing an electrostatic force to act on ink containing charged colored particles based on an image signal to eject an ink droplet on a recording medium;

ink supply means for supplying said ink to said ink jet head;

ink collection means for collecting the ink not ejected from said ink jet head; and particle diameter distribution narrowing means for narrowing a particle diameter distribution of said charged colored particles contained in said ink.

2. The ink jet recording apparatus according to claim 1, wherein:

said ink collection means is ink recovery means for recovering said ink not ejected from said ink jet head to said ink supply means; and said ink supply means and said ink recovery means constitute ink circulation means in which said ink is circulated between said ink supply means and said ink recovery means by flowing said not-ejected ink from said ink jet head to said ink supply means by said ink recovery means.

3. The ink jet recording apparatus according to claim 2, further comprising:

concentration detecting means for detecting a concentration of said charged colored particles in said ink circulating in said ink circulation means; and ink replenishment means for replenishing said ink with said colored particles in accordance with detection results obtained by said concentration detecting means.

4. The ink jet recording apparatus according to claim 3, wherein said ink replenishment means replenishes said ink circulating in said ink circulation means with concentrated ink containing said colored particles at a high concentration.

5. The ink jet recording apparatus according to claim 1, wherein said particle diameter distribution narrowing means is disposed in a supply path for said ink supplied by said ink supply means or a collection path for said ink collected by said ink collection means.

6. The ink jet recording apparatus according to claim 1, wherein said particle diameter distribution narrowing means utilizes electrophoresis.

7. The ink jet recording apparatus according to claim 1, wherein said particle diameter distribution narrowing means is provided with an electrode for causing electrophoresis of said colored particles in said ink.

8. The ink jet recording apparatus according to claim 1, wherein said particle diameter distribution narrowing means includes a main tube forming an ink inflow passage into which said ink flows from said ink supply means or said ink collection means; two branch tubes diverging from the main tube, each of which forms an ink outflow passage and out of which at least one is connected back to said ink supply means or said ink collection means; and flat plate type electrodes disposed so as to sandwich said main tube.

9. The ink jet recording apparatus according to claim 1, wherein said particle diameter distribution narrowing means includes electrode cleaning means for cleaning said electrode.

10. The ink jet recording apparatus according to claim 9, wherein:

said electrode of said particle diameter distribution narrowing means is a movable electrode; and said electrode cleaning means is a scraping blade which is slidably in contact with said movable electrode.

11. The ink jet recording apparatus according to claim 10, wherein said movable electrode of said particle diameter distribution narrowing means is moved in a same direction as a flow direction of the ink flowing through said particle diameter distribution narrowing means and at a velocity nearly equal to a flow velocity of the ink.

12. The ink jet recording apparatus according to claim 10, wherein:

said movable electrode of said particle diameter distribution narrowing means has a surface which comes into contact with said ink; and said surface is coated with a fluoroplastic.

13. The ink jet recording apparatus according to claim 1, wherein said ink in which the particle diameter distribution of said charged colored particles has been narrowed by said particle diameter distribution narrowing means is returned to said ink supply means.

14. The ink jet recording apparatus according to claim 13, wherein the particle diameter distribution of said charged colored particles is narrowed to be larger than a predetermined diameter.

15. The ink jet recording apparatus according to claim 1, wherein said particle diameter distribution narrowing means comprises a main tube which forms an ink inflow passage into which said ink flows from said ink supply means or said ink collection means; two branch tubes which diverge from the main tube, each of which forms an ink outflow passage and at least one of which is connected back to said ink supply means or said ink collection means; and a movable electrode disposed at an opening in an upper surface of said main tube.

16. An electrostatic type color ink jet recording apparatus, comprising:

an ink jet head for causing an electrostatic force to act on ink containing charged colored particles based on an image signal to eject an ink droplet on a recording medium; and particle diameter distribution narrowing means for narrowing a particle diameter distribution of said colored particles in said ink by utilizing electrophoresis of said colored particles in said ink, wherein said particle diameter distribution narrowing means includes an electrode for causing said electrophoresis and electrode cleaning means for cleaning said electrode.

17. The ink jet recording apparatus according to claim 16, wherein:

said electrode of said particle diameter distribution narrowing means is a movable electrode; and said electrode cleaning means is a scraping blade which is slidably in contact with said movable electrode.

18. The ink jet recording apparatus according to claim 17, wherein said movable electrode of said particle diameter distribution narrowing means is moved in a same direction as a flow direction of the ink flowing through said particle diameter distribution narrowing means and at a velocity nearly equal to a flow velocity of the ink.

19. The ink jet recording apparatus according to claim 17, wherein:

said movable electrode of said particle diameter distribution narrowing means has a surface which comes into contact with said ink; and said surface is coated with a fluoroplastic.

* * * * *